US005488329A

United States Patent [19]

Ridgers

[11] Patent Number: 5,488,329

[45] Date of Patent: Jan. 30, 1996

[54] STABILIZED VOLTAGE GENERATOR CIRCUIT OF THE BAND-GAP TYPE

[75] Inventor: Timothy Ridgers, Bretteville L'Orgueilleuse, France

[73] Assignee: U.S. Philips Corporation, New York, N.Y.

[21] Appl. No.: 319,899

[22] Filed: Oct. 7, 1994

[30] Foreign Application Priority Data

Oct. 13, 1993 [FR] France ..... 93 12187

[51] Int. Cl.[6] ..... G05F 1/10

[52] U.S. Cl. ..... 327/539; 327/538; 327/540; 323/313

[58] Field of Search ..... 327/538, 539, 327/540, 542, 545; 323/313, 315

[56] References Cited

U.S. PATENT DOCUMENTS 4,380,706 4/1983 Wrathall ..... 327/539

4,945,260 7/1990 Naghashineh et al. ..... 327/539

FOREIGN PATENT DOCUMENTS 0465094 8/1992 European Pat. Off. .

*Primary Examiner*—Timothy P. Callahan
*Assistant Examiner*—Jung Ho Kim
*Attorney, Agent, or Firm*—Bernard Franzblau

[57] ABSTRACT

A stabilized voltage generator circuit of the band-gap type for generating a reference voltage (Vref) which is independent of the supply voltage (Vcc) and the temperature comprises a cell whose transistors, having different emitter areas, supply a current ($I_{pt}$) proportional to the absolute temperature. The circuit includes an amplifier having an input stage of the folded cascode type, and an output stage adapted to provide symmetrical operation in order to eliminate first and second-order errors in the accuracy and stability of the reference voltage produced by the generator circuit.

9 Claims, 3 Drawing Sheets

STABILIZED VOLTAGE GENERATOR CIRCUIT OF THE BAND-GAP TYPE

BACKGROUND OF THE INVENTION

This invention relates to a voltage generator circuit comprising a cell of the band-gap type, in which a plurality of m parallel-connected transistors form a compound first transistor of a first conductivity type, whose emitter is connected to one end of a first emitter resistor, the other end of this resistor being connected to the emitter of a second transistor of the same conductivity type whose emitter area is equal to that of one of the m transistors forming the compound first transistor, which second transistor has its base coupled to that of the first transistor, the node between the emitter of the second transistor and the first emitter resistor being coupled to a first supply terminal via a second emitter resistor, which circuit further comprises an amplifier acting upon the base of the first and of the second transistor to assure equality of the currents flowing through the first and the second transistor, respectively, the power supply to the collectors of these transistors being received from a second supply terminal.

A stabilized voltage generator is known particularly from the document EP-A-0,465,094.

Circuits for the generation of voltages which are independent of temperature and supply voltage variations are very often needed for the construction of modem integrated devices.

The principle of the circuit of the so-called band-gap type, which is based on a configuration of two transistors through which a similar current flows but which have an emitter-area ratio which differs from unity, thereby producing a difference in current density in these transistors and a correlated difference in emitter-base voltage, is now mainly used because of its excellent performance.

Mainly owing to some applications of battery-operated portable apparatuses the current trend is to specify that the corresponding circuits should be able to operate at a smaller supply voltage, particularly 3 V instead of 5 V, which used to be the customary standard. Some circuit arrangements then no longer perform satisfactorily and should be modified to allow operation at a low supply voltage.

Voltage generator circuits of the band-gap type generally require a supply voltage above 3 forward-biassed junction voltages ($3.V_{BE}$) and even $4.V_{BE}$.

It is an object of the invention to provide a generator circuit of the band-gap type which can operate at a supply voltage slightly higher than the stabilised voltage generated by it (which is usually of the order of $2.V_{BE}$, i.e. $\approx$1.2 V), the stability of the circuit being at least as high as that of known circuits operating at a supply voltage of 5 V.

SUMMARY OF THE INVENTION

To this end a stabilized voltage generator circuit of the type defined in the opening paragraph is characterised, according to the invention, in that the collectors of the first and second transistors are each coupled to the second supply terminal by a first and a second current source, respectively, supplying a current of the same value, in that the amplifier has an input stage comprising two transistors of a conductivity type opposite to that of the first and second transistors and having their emitters, of equivalent area, connected to the collectors of the first and second transistors, respectively, having their bases interconnected and coupled to the first supply terminal via a circuit with a given voltage drop, and having their collectors connected to, respectively, the input and the output of a current mirror of unity ratio, comprising transistors of said first conductivity type and having their emitters coupled to the first supply terminal, in that the amplifier comprises an output stage which is basically formed by a so-called error-amplifier transistor of the first conductivity type, by a so-called bias transistor of the second conductivity type, and by a m-called compensation transistor of the first conductivity type, in that the error-amplifier transistor has an emitter area equal to twice that of each of the transistors forming the current mirror, has its base connected to the output of the current mirror, has its emitter coupled to the first supply terminal, and has its collector connected to the node between the bases of the first and second transistors, which node also forms the output of the amplifier and supplies the stabilised output voltage of the circuit, in that the bias transistor has an emitter area equivalent to that of the two transistors of the input stage together, has its emitter coupled to the second supply terminal via a third current source supplying a current equal in value to the sum of the currents of the first and the second current source, has its base connected to the bases of the two transistors of the input stage, and has its collector connected to the output node, and in that the compensation transistor has an emitter area equal to twice that of the second transistor, has its base connected to the output node, has its emitter coupled to the first supply terminal via a resistor of a value equal to that of the second emitter resistor of the cell, and has its collector connected to the emitter of the bias transistor.

A rapid analysis of this circuit shows that it can operate at a supply voltage hardly higher than $2.V_{BE}$, which voltage is related to the voltage drop envisaged in the first, the second and the third current source and to the voltage supplied by the circuit having a given voltage drop.

In this respect it is to be noted that the circuit known from the above-cited prior-art has a starting circuit comprising four junctions and one field-effect transistor used as a high-value resistor, which elements are disposed in series between the supply terminals. The known circuit therefore requires a supply voltage which should be higher than $4.V_{BE}$.

In practice the circuit in accordance with the invention can be powered with a voltage of only 2 V, if this is required.

As will be set forth in detail hereinafter, the circuit in accordance with the invention has a large number of elements operating symmetrically, which provides a high degree of compensation for residual error causes, so that the circuit has an output voltage which is highly stable with respect to temperature variations as well as supply voltage variations.

The circuit in accordance with the invention also has the feature that it becomes operative as soon as the supply voltage is applied to it.

This has the advantage that no starting device is required, as a result of which the circuit in accordance with the invention is simpler and more compact.

Moreover, it is possible to benefit from its proper turn-on and turn-off speed if the stabilized output voltage is required only intermittently by the load, in such a manner that in the meantime the consumption of the circuit can be reduced. This kind of intermittent operation is desirable, for example, for the radio section of a portable telephone set. This advantage is obtained in an embodiment of the invention which is characterised in that said second supply terminal is coupled to a supply source via a switching device for turning on and turning off the voltage generator circuit.

The switching device may take various forms, the simplest form being reduced essentially to a field-effect transistor whose control electrode receives a suitable control signal.

A preferred embodiment of the circuit in accordance with the invention is characterised in that each of the transistors of the current mirror has its emitter coupled to the first supply terminal by means of an emitter resistor of given value, another resistor whose value is equal to half said given value coupling the emitter of the error-amplifier transistor to the same first supply terminal.

Even by making the voltage drop across the relevant resistances fairly small, for example, 0.3 V nominal, this will raise the accuracy of the equality between the input and output currents of the current mirror and of a current of twice the value, supplied by the error amplifier transistor.

In a simple embodiment of the invention, which is advantageous when a small supply voltage is required, the first and the second current source of the cell are reduced to collector resistors of equal values, while the third current source is formed by another resistor whose value is equal to half that of one of said collector resistors.

BRIEF DESCRIPTION OF THE DRAWINGS

The invention will be better understood with the aid of the following description with reference to the accompanying drawings, relating to embodiments given by way of non-limitative examples.

DESCRIPTION OF THE PREFERRED EMBODIMENTS

Figure 1:
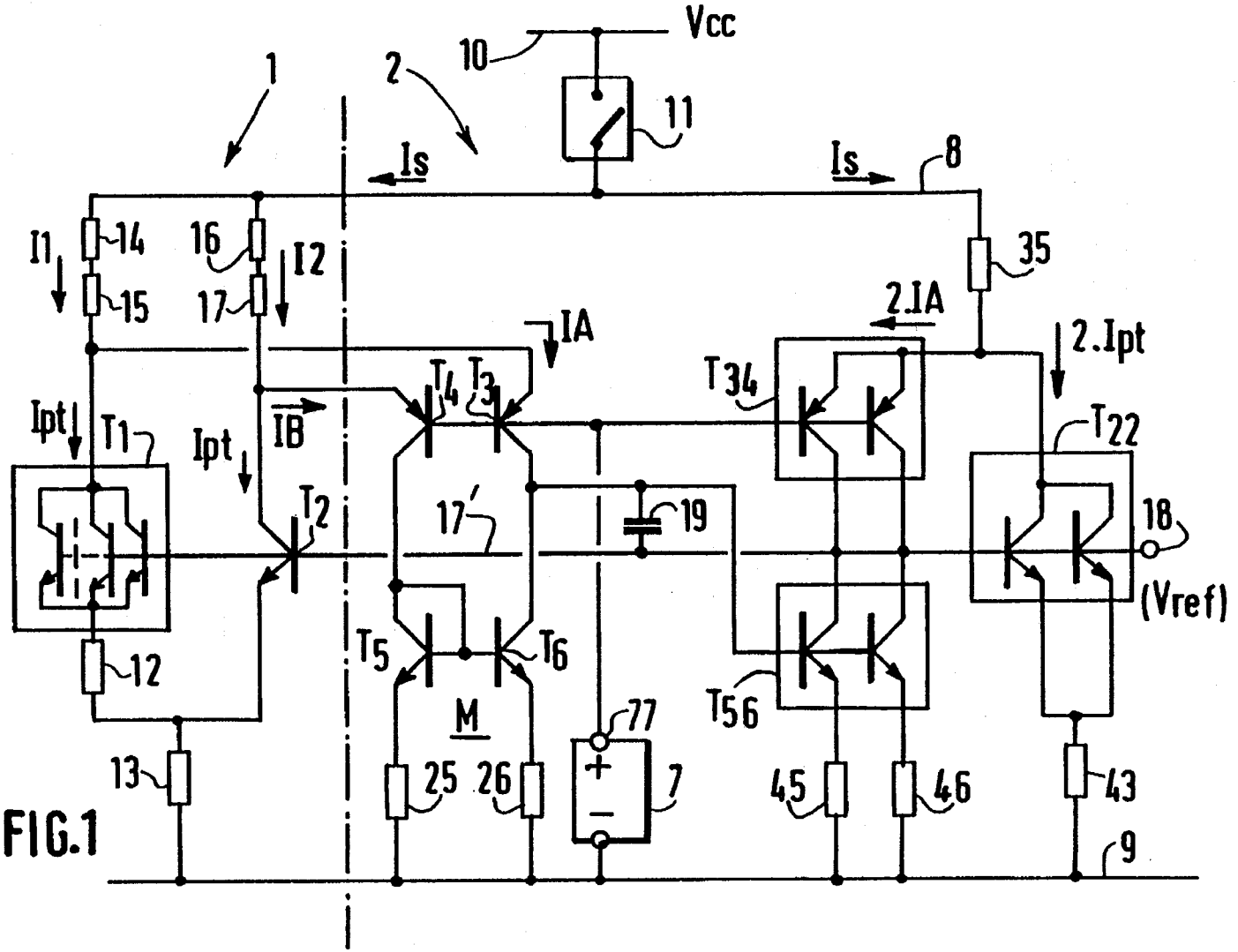
FIG. 1 is the circuit diagram of an embodiment of the circuit in accordance with the invention.

As is shown in FIG. 1, a voltage generator circuit in accordance with the invention comprises a band-gap cell 1 and an amplifier 2 supplying a reference voltage Vref. In the figure these two parts are separated by a vertical dash-dot line. The cell 1 comprises a first transistor $T_1$ and a second transistor $T_2$, the transistor $T_1$ having an emitter area which is m times as large as the emitter area of the second transistor $T_2$. Preferably, as is well-known to those skilled in the art, the transistor $T_1$ comprises m separate transistors connected in parallel, which provides a higher accuracy than a configuration comprising a single transistor $T_1$. Hereinafter, the transistor $T_1$ will be regarded as a single transistor, regardless of its configuration. Its emitter is connected to a first end of a first emitter resistor 12, whose other end is connected to the emitter of the second transistor $T_2$ and, via a second emitter resistor 13, to a first supply terminal 9 (ground). The bases of the transistors $T_1$ and $T_2$ are connected to one another. The collector supply for the transistors $T_1$ and $T_2$ is received from a second supply terminal 8 via a first collector resistor 14, 15 and a second collector resistor 16, 17, respectively, which resistors serve as paired current sources.

In the figure said collector resistors are each shown as two resistor elements in series. For technological reasons it is required, moreover, to provide another resistor whose value is equal to one of these four resistor elements.

The amplifier 2 has an input stage comprising a pair of PNP-type transistors $T_3$, $T_4$ whose emitters of equal area are connected, respectively, to the collectors of the first and the second transistor $T_1$, $T_2$. The bases of the transistors $T_3$ and $T_4$ are interconnected and coupled to the first supply terminal 9 via a circuit 7 which produces a given voltage drop close to or slightly larger than a voltage drop across a forward biassed junction. The collector of the transistor $T_4$ is connected to the input of a current mirror M formed by NPN transistors $T_5$ and $T_6$, the transistor $T_5$ being connected as a diode and the collector of the transistor $T_3$ being connected to the collector of the transistor $T_6$, the resulting node forming the output of the current mirror. In a preferred embodiment the emitters of the transistors $T_5$ and $T_6$ are coupled to the first supply terminal 9 via equal resistors 25 and 26, respectively.

Finally, the amplifier comprises an output stage which is essentially formed by an error-amplifier transistor $T_{56}$ of the NPN type, a bias transistor $T_{34}$ of the PNP type, and a compensation transistor $T_{22}$ of the NPN type. Each of the transistors forming the output stage is represented as two parallel-connected transistors for the same technological reasons as stated above, i.e. the transistor $T_{56}$ has an emitter area equivalent to the combined emitter areas of the transistors $T_5$ and $T_6$, the transistor $T_{34}$ has an emitter area equivalent to the combined emitter areas of the transistors $T_3$ and $T_4$, and the transistor $T_{22}$ has an emitter area equivalent to twice the emitter area of the transistor $T_2$. Hereinafter, these transistors will be considered as single transistors even if they are formed by two parallel-connected transistors of half the area.

The node between the collectors of the transistors $T_3$ and $T_6$, which forms the output of the input stage, is connected to the base of the error-amplifier transistor $T_{56}$. The node between the bases of the two transistors $T_3$ and $T_4$ is connected to the base of the bias transistor $T_{34}$ and the collectors of the transistors $T_{34}$ and $T_{56}$ are connected to the node 17' between the bases of the transistors $T_1$ and $T_2$, which node is coupled to the output 18 of the amplifier and to the base of the compensation transistor $T_{22}$. The node between the emitter of the bias transistor $T_{34}$ and the collector of the compensation transistor $T_{22}$ is coupled to the second supply terminal 8 via a resistor 35 whose value is equal to that of one of the resistors 14–17, i.e. either half the value of the first collector resistor 14, 15 or half the value of its equivalent, the second collector resistor 16, 17. The resistor 35 thus forms a simple current source supplying a current whose value is twice that of the current through the resistors 14, 15 (or 16, 17). The error-amplifier transistor $T_{56}$ has its emitter coupled to the first supply terminal 9 via two parallel emitter resistors 45, 46 whose values are equal to one another and which each have a value equal to that of one of the emitter resistors 25 or 26 of the transistors $T_5$ and $T_6$. Finally, the emitter of the compensation transistor $T_{22}$ is coupled to the first supply terminal 9 via a resistor 43 whose value is equal to that of the second emitter resistor 13 of the cell 1.

A capacitance 19 of low non-critical value may be connected in parallel between the node 17' and the base of the error-amplifier transistor $T_{56}$ to provide a better high-frequency stability of the generator circuit.

If the stabilised voltage generator circuit is to be used permanently said second supply terminal 8 may be coupled to the positive supply source Vcc. However, in the embodiment shown in FIG. 1, the stabilized voltage generator circuit can be turned on or turned off by means of a switching device 11 arranged in series between the actual supply source 10, which is at the positive potential Vcc, and the line referred to as the second supply terminal 8.

The operation of the circuit shown in FIG. 1 will now be explained briefly.

When a voltage is applied to the supply terminal 8 a current $I_S$ will first be divided into two components $I_1$ and $I_2$ depending on the collector resistors 14, 15 and the collector resistors 16, 17. The current $I_1$ is divided into a current $I_A$ flowing into the emitter of the transistor $T_3$ and a current $I_{pt}$ flowing into the collector of the transistor $T_1$. The current $I_2$ is divided into a current $I_B$ flowing into the emitter of the transistor $T_4$ and a current $I_{pt}$ flowing into the collector of the transistor $T_2$.

As will be seen hereinafter, the cell is powered in such a way that the collector currents of the transistor $T_1$ and the transistor $T_2$ are equal to one another.

In fact, the difference between the currents $I_A$ and $I_B$ appears on the output of the input stage of the amplifier, i.e. on the node between the collectors of the transistors $T_3$ and $T_6$, which difference is applied to the base of the transistor $T_{56}$. The collector current of the transistor $T_{56}$, which is an amplified error current, is applied to the node 17' coupling the bases of the transistors $T_1$, $T_2$, $T_{22}$ and provides negative feedback to obtain such a voltage on this node that the currents $I_{pt}$ through the transistors $T_1$ and $T_2$ are equal. Since the bases of the transistors $T_3$ and $T_4$ are connected to one another and the resistors 14, 15 and 16, 17 are equal to one another, the currents $I_A$ and $I_B$ are substantially equal.

The compensation transistor $T_{22}$ has an emitter area equal to twice that of the transistor $T_2$. Its emitter is connected to an emitter resistor 43 whose value is equal to that of the second emitter resistor 13 of the cell 1, through which a current equal to $2.I_{pt}$ flows. Likewise, the transistor $T_{22}$ also supplies a current which is substantially equal to $2.I_{pt}$. Since the resistor 35 is selected to have a value equal to that of one of the resistors 14–17 and the bias transistor $T_{34}$ is selected to have an emitter area equal to twice that of one of the transistors $T_3$ or $T_4$, it follows that the current flowing into the emitter of the transistor $T_{34}$ is highly equal to $2.I_A$. Thus, another current of the value $I_s$ will flow from the supply terminal 8 into the resistor 35.

It will be seen that the circuit described above is highly symmetrical, which ensures a high degree of compensation for residual error causes. It is recalled briefly that a cell such as 1, which is known per se, has the following property. When $I_e(T_2)$=the emitter current of the transistor $T_2$:

$$I_e(T_2)=(V_T/R_{12}).\ \log_e(m)$$

in which $R_{12}$ is the value of the resistor 12 and $V_T$ is equal to kT/q, where k= Boltzmann's constant, T=the absolute temperature, q=an electron charge, m= ratio between the emitter area of the transistor $T_1$ and that of the transistor $T_2$, and $\log_e(m)$=the natural logarithm of the ratio m. Consequently, the current $I_e(T_2)$ is a current proportional to the absolute temperature and the collector current $I_{pt}$ of the same transistor is also a current having the same property whose value is very close to $I_e(T_2)$. As stated hereinbefore, the compensation transistor $T_{22}$, in parallel with the transistor $T_2$, is adapted to supply a current equal to $2.I_{pt}$, bearing in mind that this transistor $T_{22}$ has its base coupled to the base of the transistor $T_2$ and that its collector receives a voltage identical to the collector voltage of the transistor $T_2$, the current $I_s$ flowing through the resistor 35 being substantially equal to the current $I_s$ which is the sum of the currents through the collector resistors 14, 15 and 16, 17.

The minimum voltage to be applied to the positive supply terminal 8 relative to the negative supply terminal 9 readily follows from the diagram in FIG. 1 and may be expressed as: $V(7)+V_{BE}(T_{34})+R_{35}.I_s$, where V(7) is the voltage drop in the circuit 7, $V_{BE}(T_{34})$ is the emitter-base voltage of the transistor $T_{34}$, and $R_{35}$ is the value of the resistor 35. The voltage drop across the resistor 35 can be chosen to be comparatively small, for example, smaller than 1 $V_{BE}$ but larger than several $V_T$.

Thus, the minimum supply voltage can be slightly higher than $2.V_{BE}$ and lower than $3V_{BE}$, if required. When a switching device such as the device 11 is arranged between the supply terminal 8 and a source 10 of a voltage Vcc, the voltage of this source can be equal to the voltage defined above or slightly higher if a switching device 11 having an internal resistance is chosen.

The symmetry features of the circuit shown in FIG. 1 may be summarised as follows:

The PNP transistors $T_3$, $T_4$, $T_{34}$ operate with an identical emitter/base voltage and an identical current density.

The NPN transistors $T_1$, $T_2$, $T_{22}$ operate with the same collector/base voltage and, in addition, the transistors $T_2$ and $T_{22}$ operate with the same current density and the same $V_{BE}$. The transistors $T_5$ and $T_6$ operate with identical currents under all conditions because the collector of the transistor $T_6$ is coupled to the base of the transistor $T_{56}$ which operates symmetrically to the combination of the transistors $T_5$ and $T_6$, the transistor $T_5$ having its collector connected to its base. This provides a completely symmetrical operation for the transistors $T_5$, $T_6$.

It follows that the transistors $T_3$ and $T_4$ also operate with an identical collector voltage.

The node 17', carrying the output voltage Vref, is the only point where a difference occurs with respect to the base voltage of the transistors $T_5$ and $T_6$. In fact, the value of Vref is of the order of 1.25 V independently of the supply voltage. Conversely, the base/collector voltage of the transistors $T_3$ and $T_4$ generally differs from the base/collector voltage of the transistor $T_{34}$ although it is easy to achieve voltage equality for a nominal value of the supply voltage. The collector current of the transistor $T_{34}$ then would have to be slightly smaller or larger than the sum of the collector currents of $T_3$ and $T_4$ depending on whether the voltage drop across the resistors 25 and 26 has been selected to be smaller or larger than the voltage drop across the circuit 7, and/or whether the supply voltage differs from its nominal value.

Nevertheless, the effect of the cascode-type configuration of the combination of PNP transistors is that the output resistance of these transistors is multiplied, particularly when a comparatively large voltage drop across the resistors 35, 14–17 is chosen, i.e. distinctly higher than $V_T$.

Likewise, there can be a difference in base/collector voltage between the transistor $T_{56}$ and the transistors $T_5$, $T_6$ if the supply voltage differs from the nominal value for which the elements have been calculated, but this error can be reduced to a large extent by the use of emitter resistors 25, 26, 45, 46 of sufficiently high value to ensure that the voltage drop across these resistors is $>V_T$, thereby degenerating the emitter characteristics of these transistors.

It is to be noted that since all of the base currents of the PNP transistors $T_3$, $T_4$ and $T_{34}$ are drained via the same voltage drop across the circuit 7, any variation of this voltage drop will produce the same effect on the bases of these transistors. Moreover, the current gain of these transistors can be comparatively small without giving rise to any significant error of the resulting voltage Vref.

Figure 2A:
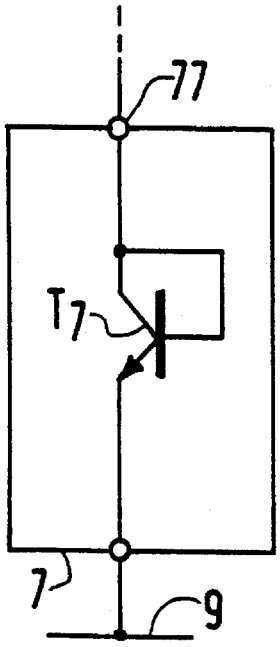
FIGS. 2A to 2C are diagrams of different examples of possible arrangements for realising the circuit with a given voltage drop, which forms a part of the generator circuit shown in FIG. 1.
Figure 2B:
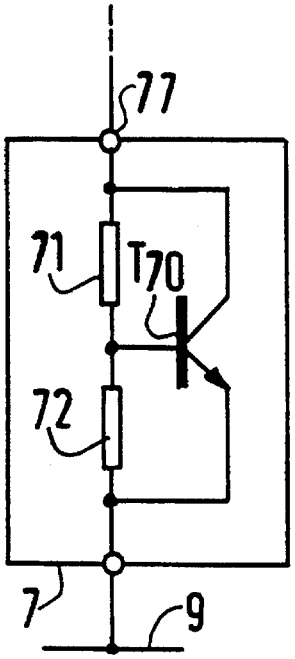
Figure 2C:
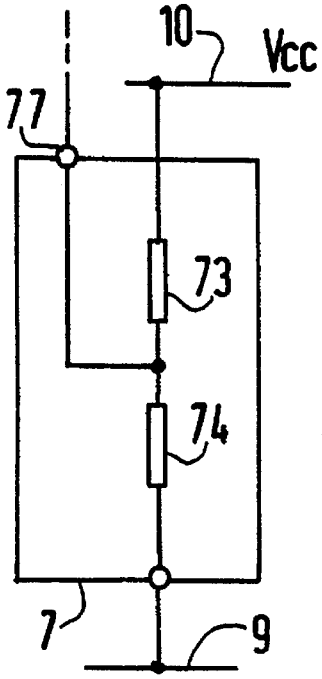

FIGS. 2A, 2B and 2C show examples of the block 7 in FIG. 1 which produces a given voltage drop close to or slightly larger than that of a forward biassed junction. The value of this voltage drop is selected mainly as a function of the nominal voltage on the second supply terminal 8 and the voltage drops across the resistors 25, 26, 45, 46. A preferred value is chosen to ensure that, at the nominal supply voltage, an approximate equality is obtained between the voltage Vref on the node 17' and the voltage of the collectors of the transistors $T_3$ and $T_4$. For this nominal supply voltage the generator circuit then operates in an optimum manner with a very high degree of symmetry to eliminate most second-order errors.

In FIG. 2A the circuit 7 is reduced to a forward-biassed diode-connected bipolar transistor $T_7$. In a variant, not shown, the bipolar transistor $T_7$ can be replaced by an N-channel MOS transistor connected in an equivalent manner so as to produce a voltage drop corresponding to its threshold voltage. A voltage drop slightly higher than one $V_{BE}$ is then obtained, whose behaviour as a function of temperature is advantageous for the operation of the generator circuit.

In FIG. 2B the circuit 7 takes the form of an arrangement which is known per se, in which a resistor bridge 71, 72 is connected in parallel with the collector-emitter path of an NPN transistor $T_{70}$ and whose base is connected to the central node of this resistor bridge. This arrangement provides a voltage drop proportional to one $V_{BE}$, the proportionality factor, which is greater than unity, being selected arbitrarily as a function of the values of the resistors 71 and 72.

FIG. 2C shows still another example of an arrangement which can be used for the circuit 7 in FIG. 1 and which in the present case is reduced to a resistor bridge 73, 74 connected between the second supply terminal 8 (or the supply source Vcc) and ground (terminal 9). The voltage drop used for producing the base current of the transistors $T_3$, $T_4$ and $T_{34}$ appears across the resistor 74. This voltage drop is influenced by supply voltage variations but this is not unfavourable because the voltage across the resistor 74 varies in the same sense as the variation of the emitter voltage of the transistors $T_3$ and $T_4$. The variation of the currents $I_A$ and $I_B$ as a function of variations of the supply voltage Vcc is then smaller.

In general, a circuit 7 will be chosen which provides a voltage drop which becomes smaller, and closer to 1 $V_{BE}$, according as the minimum supply voltage is required to be smaller.

Figure 3:
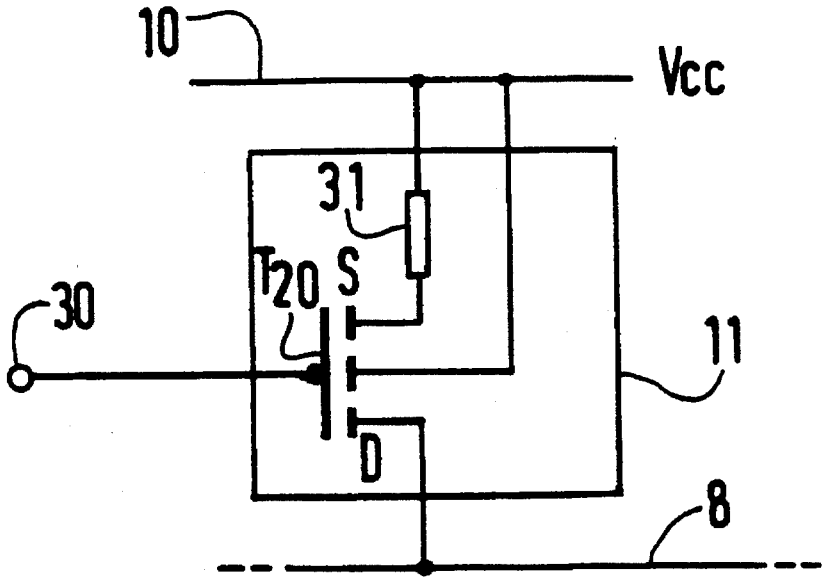
FIG. 3 shows a first practical example of a switching device which is shown as a block in FIG. 1.

FIG. 3 shows an example of the switching device 11 in FIG. 1. Basically, it comprises an enhancement-type P-channel field-effect transistor $T_{20}$ having its source connected to the supply source 10 of the voltage Vcc via a resistor 31 and having its drain connected to the second supply terminal 8. A control signal is applied to the gate of this transistor $T_{20}$ via a terminal 30 to turn on and turn off the transistor under the influence of a control voltage varying between ground potential and the voltage Vcc. In the description with reference to FIG. 1 allowance is to be made for the resistor 31 in series with the source of the transistor $T_{20}$ as well as the internal resistance of the transistor. These resistances, disposed in series between the supply source 10 and said second supply terminal 8, produce a voltage drop caused by the current $2.I_s$.

Figure 4:
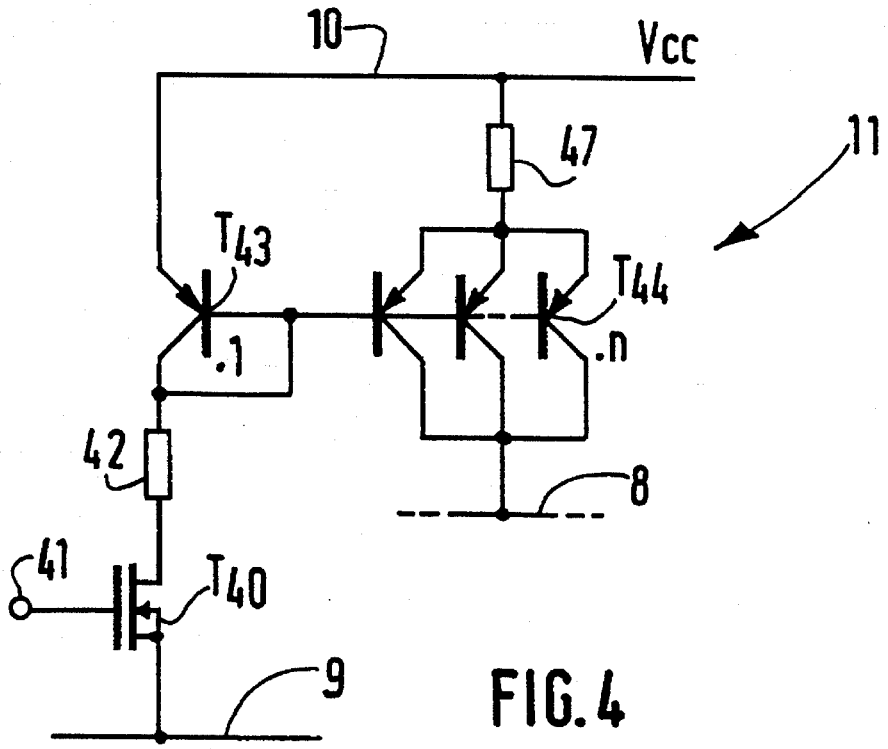
FIG. 4 shows a second example of this switching device, which also effects a pre-regulation of the supply current of the voltage regulator.

FIG. 4 gives another example of the switching device 11 shown in FIG. 1, in which example the current (2.I) supplied to the amplifier 2 in FIG. 1 is pre-regulated.

In FIG. 4 an N-channel MOS-FET $T_{40}$ has its source connected to the first supply terminal 9 (ground). Its gate receives a suitable control signal from a control terminal 41. Its drain is coupled to the supply source 10 of the voltage $V_{cc}$ via a resistor 42 and a diode-connected PNP-type transistor $T_{43}$. Another PNP transistor $T_{44}$ has its base connected to the base of the transistor $T_{43}$ and has its emitter, whose area is n times as large as that of the emitter of the transistor $T_{43}$, coupled to the source 10 via an emitter resistor 47. The collector of the transistor $T_{44}$ supplies a current to the second supply terminal 8 whose value, which is given for a nominal voltage Vcc, varies logarithmically and, as a consequence, slightly when Vcc varies.

In some way the circuit shown in FIG. 4 is an equivalent of the circuit shown in FIG. 3, in which the source resistance has a value which varies in the same sense as the value of Vcc, thereby reducing the variations of the voltage produced on the terminal 8.

Figure 5:
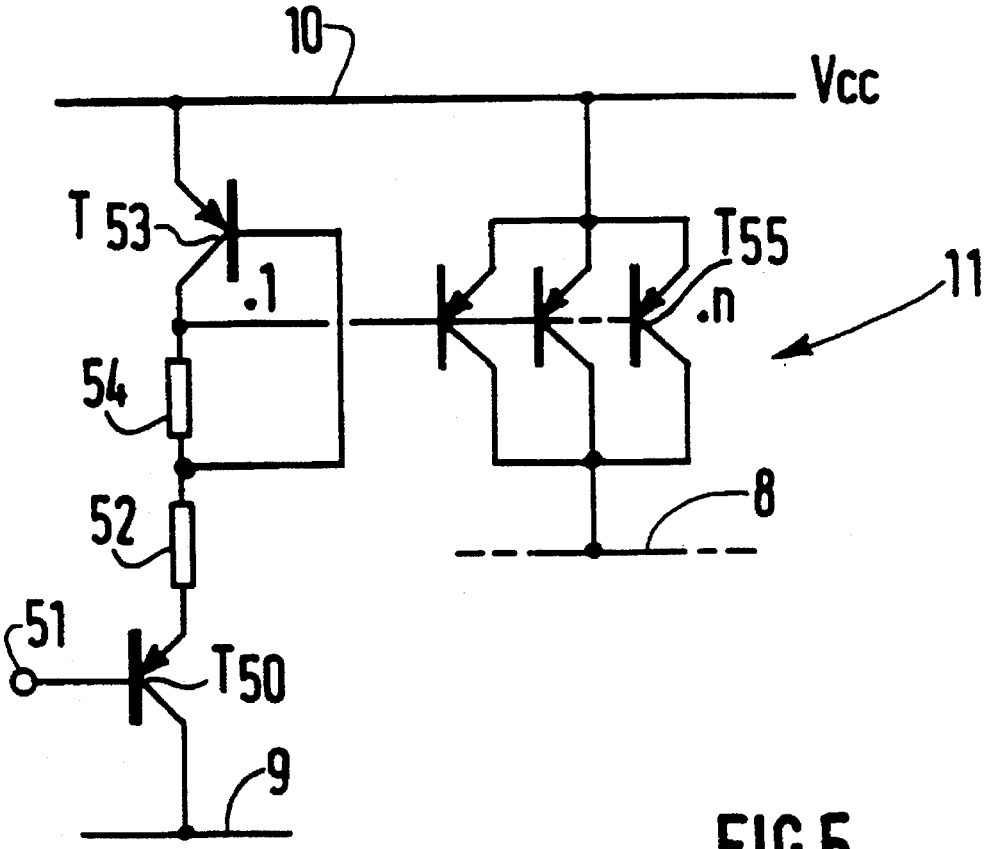
FIG. 5 shows the diagram of a third example of a switching device with pre-regulation of the supply current.

FIG. 5 shows a variant of the circuit shown in FIG. 4, in which the transistor $T_{40}$ in FIG. 4 is replaced by a PNP type bipolar transistor $T_{50}$ whose collector is connected to the terminal 9 (ground) and whose base receives a suitable control signal from the control terminal 51. The emitter of the transistor $T_{50}$ is coupled to the supply source 10 (Vcc) via a resistor 52 of high value and the base-emitter path of a PNP transistor $T_{53}$. Between the resistor 52 and the collector of this transistor $T_{53}$, a resistor 54 is arranged whose value is selected to produce a voltage drop close to $V_T$ under rated operating conditions.

The collector of the transistor $T_{53}$ is connected to the base of another PNP transistor $T_{55}$ having its emitter, whose area is n times as large as that of the emitter of the transistor $T_{53}$, connected to the supply source 10.

The collector of the transistor $T_{55}$ supplies a pre-regulated current to the terminal 8, whose value varies little as a function of variations of Vcc around its nominal value, as in the preceding example.

It will be appreciated that modifications of details are conceivable to those skilled in the art, particularly as regards the choice of the transistor types in the examples described above, without departing from the scope of the invention.

For example, the circuit in FIG. 4 uses a MOS transistor $T_{40}$ for interrupting the power supply while the circuit in FIG. 5 employs a bipolar transistor $T_{50}$ to realise the same function. Obviously, the expert will easily recognise that the use of transistors of these types could have been interchanged and is in no way specific of each of the examples described, where likewise an NPN type transistor could have been used.

Moreover, it is to be noted that a pre-regulation function for the supply current has been described in conjunction with the function of interrupting the power supply in accordance with a preferred embodiment. However, it will be evident that these functions can be used in a wholly independent manner. Finally, in the description of the invention it has been stated, for the sake of simplicity, that the different branches of the circuit operate symmetrically as a result of the equality of the currents flowing therein and comprise transistors having simple emitter area ratios in order to obtain this equality of currents. This construction is preferred for its simplicity. However, the expert will appreciate that it is also possible to have a proportionality ratio different from unity (for example $I_A$=k.$I_B$, current mirror M having an output/input ratio=k, $T_{34}$ having an emitter area equal to the sum of the areas of $T_3$ and $T_4$ . . . etc.). The resulting value of Vref will then be different but the inherent characteristics of the circuit in accordance with the invention will remain the same, and with the same advantages.

I claim:

1. A voltage generator circuit comprising: a cell of the band-gap type, in which a plurality of m parallel-connected transistors form a compound first transistor of a first conductivity type, whose emitter is connected to one end of a first emitter resistor, an other end of said resistor being connected to an emitter of a second transistor of the same conductivity type whose emitter area is equal to an emitter area of one of the m transistors forming the compound first transistor, the second transistor having its base coupled to a base of the first transistor to form an output node, a first node between the emitter of the second transistor and the first emitter resistor being coupled to a first supply terminal via a second emitter resistor, an amplifier acting upon the base of the first and of the second transistor to assure equality of currents flowing through the first and the second transistor, respectively, wherein collectors of the first and second transistors are each coupled to a second supply terminal by a first and a second current source, respectively, supplying a current of the same value, wherein the amplifier has an input stage comprising two transistors of a second conductivity type opposite to that of the first and second transistors and having emitters, of equivalent area, connected to the collectors of the first and second transistors, respectively, having their bases interconnected and coupled to the first supply terminal via a circuit with a given voltage drop, and having their collectors connected to, respectively, the input and the output of a current mirror of unity ratio, comprising transistors of said first conductivity type and having their emitters coupled to the first supply terminal, in that the amplifier comprises an output stage comprising an error-amplifier transistor of the first conductivity type, a bias transistor of the second conductivity type, and a compensation transistor of the first conductivity type, wherein the error-amplifier transistor has an emitter area equal to twice an emitter area of each of the transistors forming the current mirror, a base connected to an output of the current mirror, its emitter coupled to the first supply terminal, and its collector connected to the output node which forms the output of the amplifier and supplies the stabilized output voltage (Vref) of the circuit, in that the bias transistor has an emitter area equivalent to that of the two transistors of the input stage together, has its emitter coupled to the second supply terminal via a third current source supplying a current equal in value to a sum of currents of the first and the second current source, has its base connected to the bases of the two transistors of the input stage, and has its collector connected to the output node, and in that the compensation transistor has an emitter area equal to twice that of the second transistor, has its base connected to the output node, has its emitter coupled to the first supply terminal via a resistor of a value equal to a resistance value of the second emitter resistor of the cell, and has its collector connected to the emitter of the bias transistor.

2. A circuit as claimed in claim 1, wherein the first and the second current source of the cell comprise collector resistors of equal values, and the third current source comprises another resistor whose value is equal to half that of one of said collector resistors.

3. A circuit as claimed in claim 1, wherein each of the transistors of the current mirror has its emitter coupled to the first supply terminal by means of an emitter resistor of a given value, another resistor whose value is equal to half said given value coupling the emitter of the error-amplifier transistor to said first supply terminal.

4. A circuit as claimed in claim 1 wherein said second supply terminal is coupled to a supply source via a switching device for turning on and turning off the voltage generator circuit.

5. A circuit as claimed in claim 4, wherein the transistors of the second conductivity type are PNP transistors, the switching device comprises a p-channel field-effect transistor whose gate receives a control signal, whose drain is coupled to the second supply terminal; and whose source is coupled to a positive supply source via a current-limiting resistor.

6. A circuit as claimed in claim 1 wherein said second supply terminal is coupled to a supply source via a pre-regulation circuit for a current supplied to the voltage regulator said circuit having an impedance which varies in the same sense as a voltage (Vcc) of the supply source.

7. A circuit as claimed in claim 2, wherein each of the transistors of the current mirror has its emitter coupled to the first supply terminal by means of an emitter resistor of a given value, and a resistor whose value is equal to half said given value couples the emitter of the error-amplifier transistor to said first supply terminal.

8. A circuit as claimed in claim 3, wherein said second supply terminal is coupled to a supply source via a switching device for turning on and turning off the voltage generator circuit.

9. A circuit as claimed in claim 3, wherein said second supply terminal is coupled to a supply source via a pre-regulation circuit for a current supplied to the voltage regulator, said circuit having an impedance which varies in the same sense as the voltage (Vcc) of the supply source.

* * * * *